US008836581B2

(12) United States Patent
Nysen

(10) Patent No.: US 8,836,581 B2
(45) Date of Patent: Sep. 16, 2014

(54) ANTENNA HAVING INTERNAL AND EXTERNAL STRUCTURES

(75) Inventor: Paul A. Nysen, Carlsbad, CA (US)

(73) Assignee: NETGEAR, Inc., San Jose, CA (US)

( * ) Notice: Subject to any disclaimer, the term of this patent is extended or adjusted under 35 U.S.C. 154(b) by 419 days.

(21) Appl. No.: 12/983,679

(22) Filed: Jan. 3, 2011

(65) Prior Publication Data

US 2012/0169562 A1 Jul. 5, 2012

(51) Int. Cl.

| | |
|---|---|
| ***H01Q 1/36*** | (2006.01) |
| ***H01Q 9/04*** | (2006.01) |
| ***H01Q 9/26*** | (2006.01) |
| ***H01Q 21/24*** | (2006.01) |
| ***H01Q 5/00*** | (2006.01) |
| ***H01Q 9/28*** | (2006.01) |
| ***H01Q 9/40*** | (2006.01) |

(52) U.S. Cl.

CPC ..... *H01Q 9/0421* (2013.01); *H01Q 9/0442* (2013.01); *H01Q 9/0414* (2013.01); *H01Q 9/26* (2013.01); *H01Q 21/24* (2013.01); *H01Q 5/0072* (2013.01); *H01Q 9/28* (2013.01); *H01Q 5/0062* (2013.01); *H01Q 9/40* (2013.01)

USPC ..... 343/700 MS; 343/843; 343/825

(58) Field of Classification Search

CPC ... H01Q 5/0062; H01Q 21/24; H01Q 9/0421; H01Q 9/0442; H01Q 5/0072; H01Q 9/28; H01Q 9/0414; H01Q 9/40; H01Q 9/26

USPC ..... 343/843, 825, 700 MS

See application file for complete search history.

(56) References Cited

U.S. PATENT DOCUMENTS

| | | | | |
|---|---|---|---|---|
| 2004/0070540 | A1 * | 4/2004 | Wang et al. | 343/702 |
| 2008/0158069 | A1 * | 7/2008 | Mateus Mendes et al. | 343/700 MS |

* cited by examiner

*Primary Examiner* — Jacob Y Choi
*Assistant Examiner* — Jae Kim
(74) *Attorney, Agent, or Firm* — Boyle Fredrickson, S.C.

(57) ABSTRACT

The present technology provides an improved antenna having a conductive first plate, a conductive second plate and a conductive third plate. The conductive first plate and the conductive second plate are disposed and have an electrical connection to form an external antenna structure having a U-shaped cross section. The conductive third plate is disposed parallel to the conductive first plate between the conductive first plate and the conductive second plate and has a proximate edge proximate the electrical connection. The conductive third plate has an electrical length with respect to the proximate edge corresponding to an odd integer multiple of a quarter of a guide wavelength associated with a resonant frequency of the antenna. The conductive third plate forms part of an internal antenna structure.

18 Claims, 8 Drawing Sheets

ANTENNA HAVING INTERNAL AND EXTERNAL STRUCTURES

TECHNICAL FIELD

The present technology pertains in general to antennas and in particular to antennas for use in wireless devices.

BACKGROUND

Data consumption via wireless devices has stimulated increasing demand for small, broadband, low-cost antennas that support multi-band operation. Space and weight constraints imposed by wireless devices, however, require few and/or small and often integrated antennas. While antennas including planar antenna structures such as patch antennas, for example, have a low profile, are light weight and incur low production cost, bandwidth capabilities of these antennas can be insufficient for use in multi-band wireless communication systems. Examples of wireless communication systems include Global System for Mobile Communications (GSM) 1800, Personal Communications Service (PCS) 1900, wideband code division multiple access standard IMT 2000, Bluetooth ISM (Industrial, Scientific, and Medical) and other wireless communication systems, for example.

A typical patch antenna 100 is shown in a side view in FIG. 1. The patch antenna 100 comprises a ground plane 102, a patch (also referred to as a conductor plate) 104, and a feed 106, for example a connection to a suitable coaxial cable. This type of antenna has an electrical length that typically corresponds with half the guide wavelength, $\lambda_0$, wherein the guide wavelength corresponds with the wavelength of the electromagnetic field within the antenna at the resonant frequency, $f_0$, at the transverse magnetic (TM) mode TM 01.

Various modifications to the type of antenna shown in FIG. 1, including openings in the patch 104 and/or the ground plane 102, have been made in the art to improve various aspects of antenna performance. Shorting structures including shorting posts and shorting walls for example, furthermore, have been used in combination with patch antennas to reduce the overall size of the patch antenna while attempting to maintain bandwidth. Resulting antennas have been reduced in electrical length to $\lambda_0/4$ and below. Respective antennas have been employed in 3G IMT-2000 mobile handsets, for example. However, this type of antenna provides only marginally improved performance at the expense of significantly greater complexity, and can be difficult and expensive to manufacture.

It has been shown that the size of shorted-patch antennas, which are typically referred to as planar inverted-F antennas (PIFAs), can be further reduced to below $\lambda_0/4$ in various ways, for example, by disposing shorting structures proximate a corner of a patch plate or by biasing, often referred to as loading, the PIFA. Further size reductions have been achieved by folding and or shaping the patch in certain ways to decrease the geometrical size of the antenna while maintaining the guide wavelength. FIG. 2 illustrates a folded shorted-patch antenna 200 that has been reduced in length to about $\lambda_0/8$. This structure is based on a shorted ¼ wave patch that has been folded over itself and laid on a ground plane. This results in a structure that is only about $\lambda_0/8$ long as shown. The folded shorted-patch antenna includes two patches, a first patch 204 that is shorted to the ground plane 202 with a metal wall 207. This patch can be folded from the surface skin of the ground plane 202. A second patch 208 is shorted to the ground plane 202 with a metal wall 205 and is provided with a feed point 206. Patch 205 can be formed from an initial patch which can be folded over itself thereby becoming a patch half the size of the original. The wall 207 is spaced to form a gap between itself and the patch 208. Moreover, printed antennas with a surface area of only about 25% of that of a patch antenna 100 as shown in FIG. 1 have been made possible by incorporating adequately disposed slots and shorting pins. U.S. Pat. Nos. 4,980,694, 5,355,143 and 6,914,563, and United States Patent Application Publication Nos. 2002/0175871, 2003/0107518 and 2008/0129625 describe examples of the noted known solutions.

While patch antennas with notably reduced sizes have been achieved, bandwidth characteristics have been somewhat neglected. Therefore there is a need for a solution that overcomes at least one of the deficiencies in the art.

This background information is provided to reveal information believed by the applicant to be of possible relevance to the present technology. No admission is necessarily intended, nor should be construed, that any of the preceding information constitutes prior art against the present technology.

SUMMARY

An object of the present technology is to provide an antenna. In accordance with one aspect of the present technology, there is provided an antenna comprising: a conductive first plate and a conductive second plate, the conductive first plate and the conductive second plate disposed and having an electrical connection to form an external antenna structure having a substantially U-shaped cross section; and a conductive third plate disposed substantially parallel to the conductive first plate between the conductive first plate and the conductive second plate, the conductive third plate having a proximate edge proximate the electrical connection and an electrical length with respect to the proximate edge corresponding to substantially an odd integer multiple of a quarter of a guide wavelength associated with a resonant frequency of the antenna; wherein the conductive third plate forms part of an internal antenna structure.

DETAILED DESCRIPTION OF THE TECHNOLOGY

Definitions

Figure 1:
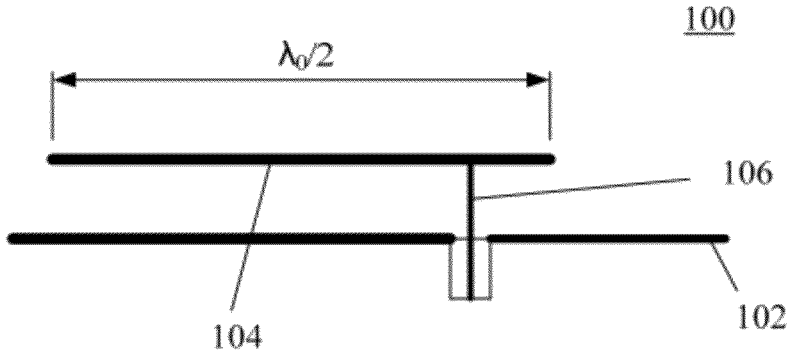
FIG. 1 illustrates a side view of a prior art antenna.
Figure 2:
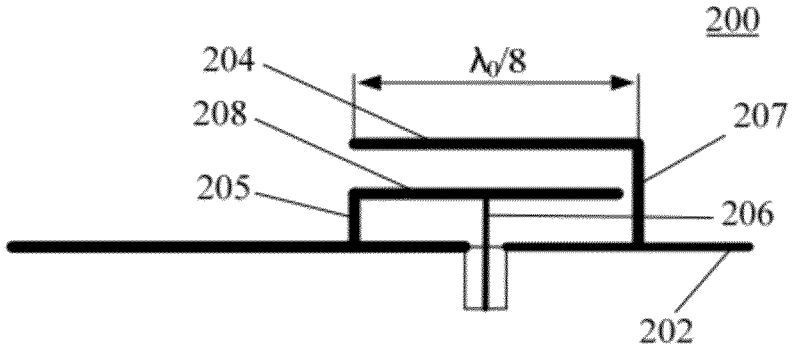
FIG. 2 illustrates a side view of a prior art antenna

As used herein, the term "about" refers to a +/−10% variation from the nominal value. It is to be understood that such a variation is always included in a given value provided herein, whether or not it is specifically referred to.

As used herein, the term "bandwidth" refers to a range of one or more parameters or variables of a characteristic figure of an antenna within which the characteristic figure remains within predetermined limits. For example, when a characteristic figure of an antenna exhibits a local or global minimum at a certain frequency, bandwidth may refer to the range of frequencies surrounding the certain frequency within which the characteristic figure remains either up to twice or above half the respective local or global minimum or maximum. With respect to a characteristic figure remaining above half a maximum, bandwidth is often referred to as "full-width at half maximum". Bandwidth may also refer to a range of frequencies within which a characteristic figure remains within 3 decibel (dB) of a proximate minimum or maximum of the characteristic figure. A 3 dB limit is typically used when the characteristic figure relates to power or energy. Limits other than half/double or 3 dB may be used to define bandwidth, for example, quarter/quadruple, 4 dB or the like. As used herein, a characteristic figure of an antenna may include impedance, gain, return loss or other characteristic figure of an antenna.

As used herein, the term "plate" refers to a substantially flat to predeterminedly curved, body with a regular, irregular or arbitrary perimeter having a predetermined thickness or whose thickness can vary within a predetermined range and that substantially extends in two dimensions. The term "conductive plate" refers to an electrically conductive plate.

Unless defined otherwise, all technical and scientific terms used herein have the same meaning as commonly understood by one of ordinary skill in the art to which this technology belongs.

An antenna according to aspects of the present technology is configured to provide a predetermined bandwidth at a predetermined operating frequency. The antenna comprises an external antenna structure and an internal antenna structure. The external antenna structure and the internal antenna structure are configured to support resonance of electromagnetic waves in the antenna at its one or more predetermined operating frequencies. The antenna is configured so it can be used for transmission and/or reception of signals within a predetermined range of frequencies of electromagnetic radiation. The antenna can be configured to emit and respond to substantially linearly polarized electrical fields with a predetermined axis of polarization.

Depending on the embodiment, an antenna may be considered to provide one or more slots, notches, apertures, spirals, combs, or be formed as described herein, for example by folding, or in other ways. Accordingly, terms such as aperture antenna, patch antenna, folded-patch antenna, aperture-in-aperture antenna, notch-in-notch antenna, slot-in-slot antenna, spiral antenna or comb antenna may be used to refer to certain antennas according to embodiments of the present technology.

Depending on the embodiment, one or more components of the antenna may be formed as solid or hollow bodies. Components of the antenna may comprise same, similar or different electrically conductive and/or dielectric material. For example, the antenna may comprise one or more materials including metals such as aluminum, copper, silver, gold, zinc, iron, or alloys thereof with or without other elements, or other electrically conductive material, or insulating and/or dielectric material with predetermined dielectric properties. According to an embodiment of the present technology, the materials used in the antenna can be suitable for carrying electrical current and/or electromagnetic radiation at predetermined frequencies.

Dielectric materials can be used to alter the guide wavelength and/or the bandwidth of an antenna, for example to decrease or increase the guide wavelength and/or the bandwidth, respectively, in comparison to an otherwise dielectric-free antenna. The addition of dielectric materials to an antenna can substantially reduce the guide wavelength, increase the resonance frequency and/or decrease the bandwidth of the antenna.

According to embodiments of the present technology, one or more components of the antenna may be formed and/or joined by painting, spraying, casting, drawing, folding, cutting, planing, routing, grinding, sanding, honing, welding, soldering, gluing, rolling, forging, ablating, plasma depositing, etching, heating, cooling, drying, and/or by resiliently biasing into abutting positions, or other suitable manner, for example.

Antennas according to embodiments of the present technology can be used for transmitting signals, for receiving signals, or for both transmitting and receiving signals. Corresponding antennas may be operatively interconnected to an adequate signal drive source or a signal amplifier, or both, for example. Signals may be alternately or simultaneously received and transmitted via an antenna according to embodiments of the present technology. Duplex communication via antennas may be achieved in a number of ways including time-division multiplexing, frequency-division multiplexing or other suitable method, for example.

External Antenna Structure

The external antenna structure comprises a conductive first plate and a conductive second plate, the conductive first plate and the conductive second plate are disposed and have an electrical connection to form the external antenna structure having a substantially U-shaped cross section. The conductive first plate and/or the conductive second plate have electrical lengths with respect to the electrical connection that corresponds to about an odd integer multiple of a quarter of a guide wavelength $\lambda_0$ associated with a resonant frequency of the antenna. Depending on the embodiment, the odd integer multiple can be 1, 3, 5, 7 and so forth or generally 2n−1 with n being a positive integer number. In order to keep the antenna small, the conductive first plate and/or the conductive second plate can be configured to have an electrical length of about $\lambda_0/4$.

Figure 3A:
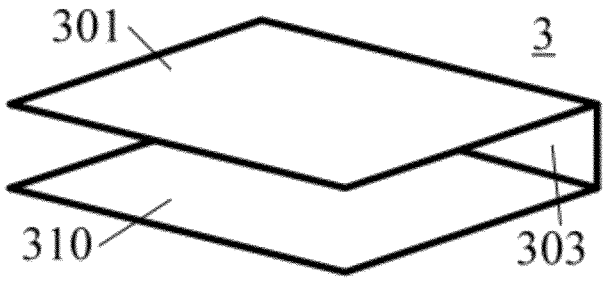
FIG. 3A illustrates a perspective view of an external antenna structure of an antenna according to embodiments of the present technology.

FIG. 3A illustrates an external antenna structure 3 of an antenna according to some embodiments of the present technology. The external antenna structure 3 comprises a conductive first plate 310, a conductive second plate 301, and an electrical connection 303 between the conductive first plate 310 and the conductive second plate 301. It is noted that while the conductive first plate 310, the conductive second plate 301 and the electrical connection 303 are configured as substantially flat, rectangular, solid bodies, they can be shaped differently in other embodiments. For example, other embodiments can have a conductive first plate, conductive second plate and/or electrical connection that has a curved surface, quadratic, polygonal or irregular perimeter, solid or hollow interior and/or is otherwise configured. Depending on the embodiment, the conductive first plate 310 and the conductive second plate 301 may be substantially parallel, tapered towards or away from the electrical connection 303, oblique, or otherwise aligned relative to each other.

Depending on the embodiment, the electrical connection may be of different shapes, for example, a wire, a network or curtain of wires, a mesh, a plate or other shape. The cross section of the electrical connection may be uniform or vary in a predetermined manner with location between the conductive first plate and the conductive second plate. The electrical connection may be integrally formed with the conductive first plate and/or the conductive second plate, for example, shaped from one piece, or it may be welded, soldered, conductively glued, resiliently biased into abutting positions, or otherwise established, for example. Depending on the embodiment, the electrical connection may have a width substantially narrower than the conductive first plate 310 and/or the conductive second plate 301, for example, the electrical connection 303 may be formed from a piece of wire. Narrowing the electrical connection 303, for example, by employing a piece of wire, can be used to tune one or more characteristics of an antenna.

Internal Antenna Structure

Depending on the embodiment, the internal antenna structure may be formed from different conductive plates as described herein. According to an embodiment, the internal antenna structure comprises at least a conductive third plate disposed substantially parallel to the conductive first plate between the conductive first plate and the conductive second plate. The conductive third plate has a proximate edge proximate the electrical connection.

Figure 3B:
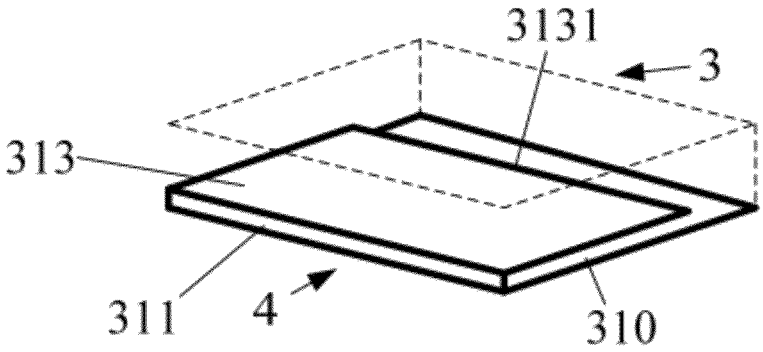
FIG. 3B illustrates a perspective view of an internal antenna structure of an antenna according to embodiments of the present technology.
Figure 3C:
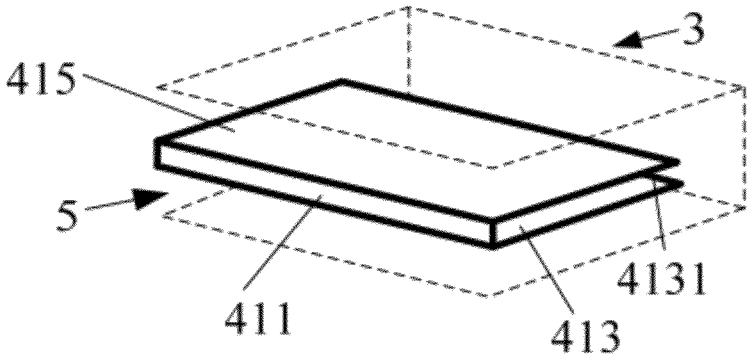
FIG. 3C illustrates a perspective view of an internal antenna structure of an antenna according to embodiments of the present technology.

FIG. 3B and FIG. 3C illustrate examples of internal antenna structures 4 and 5 according to different embodiments of the present technology. FIG. 3B illustrates an antenna including internal antenna structure 4 in combination with the external antenna structure 3 also illustrated in FIG. 3A. The portion of the external antenna structure 3 not considered to form part of the internal antenna structure 4 is outlined in dashed line. The internal antenna structure 4 comprises a third plate 313, an optional conductive front plate 311 and the conductive first plate 310, which is also considered part of the external antenna structure 3. The conductive front plate 311 electrically connects the conductive first plate 310 to the conductive third plate 313 opposite a proximate edge 3131 of the conductive third plate 313. The conductive front plate 311, the conductive first plate 310 and the conductive third plate 313 may be integrally formed, for example, by folding, but may be formed in other ways as generally described herein in other embodiments.

FIG. 3C illustrates an antenna including internal antenna structure 5 in combination with the external antenna structure 3 also illustrated in FIG. 3A. The external antenna structure 3 is outlined in dashed line. The internal antenna structure 5 comprises a conductive third plate 413, a conductive fourth plate 415 and a conductive front plate 411. The conductive front plate 411 electrically connects the conductive third plate 413 to the conductive fourth plate 415 opposite a proximate edge 4131 of the conductive third plate 413. The conductive front plate 411, the conductive third plate 413 and the conductive fourth plate 415 may be integrally formed, for example, by folding, but may be formed in other ways as generally described herein in other embodiments.

Depending on the embodiment, the internal antenna structure 5 may be durably disposed relative to the external antenna structure 3 via a suitable dielectric material (not illustrated), dielectric elements or the internal antenna structure 5 and the external antenna structure 3 may be otherwise affixed relative to one another. Dielectric material may be used to at least partially fill the space within the external antenna structure. The internal antenna structure 5 may be disposed at a center or off-center position between the conductive first plate 310 and the conductive second plate 301 of the external antenna structure 3. Similar considerations apply with respect to the internal antenna structure 4.

Depending on the embodiment, the conductive third plate 413 and the conductive fourth plate 415 may be disposed substantially parallel to the conductive first plate 310 and the conductive second plate 301, respectively, or otherwise oriented with respect to one another. The front wall 411 may be disposed substantially parallel or otherwise aligned relative to the electrical connection 303. The front wall 411 may be parallel or obliquely protruding, or be substantially aligned flat with the external antenna structure. Similar considerations apply with respect to the internal antenna structure 4.

The relative alignment and disposition of internal antenna structures 4 and 5 with respect to their corresponding external antenna structure 3 can affect a number of properties of the resulting antenna including guide wavelength, bandwidth and radiation pattern or other properties of the antenna. Depending on the embodiment, the bandwidth of an antenna with an internal antenna structure 4 may be smaller than that of an otherwise comparably configured antenna with an internal antenna structure 5.

An antenna according to embodiments of the present technology may include one or more bandwidth improving elements, for example, one or more conductive plates or other conductive bodies aligned and disposed in a predetermined fashion relative to the internal antenna structure and/or the external antenna structure. Bandwidth improving elements may be configured as one or more plates disposed proximate the external antenna structure substantially parallel the open sides of, or may be generally U-shaped and partially surrounding the external antenna structure, for example. A ¼ wave resonant condition can be established by loading the inside of 313 or 415 with a suitable dielectric material. In so doing, this can reduce the effective impedance of the internal antenna structure thus resulting in improved bandwidth and a flatter, for example more constant, return loss within that bandwidth.

The technology will now be described with reference to a specific example. It will be understood that the example is intended to describe aspects of some embodiments of the technology and is not intended to limit the technology in any way.

EXAMPLES

Example 1

Figure 4A:
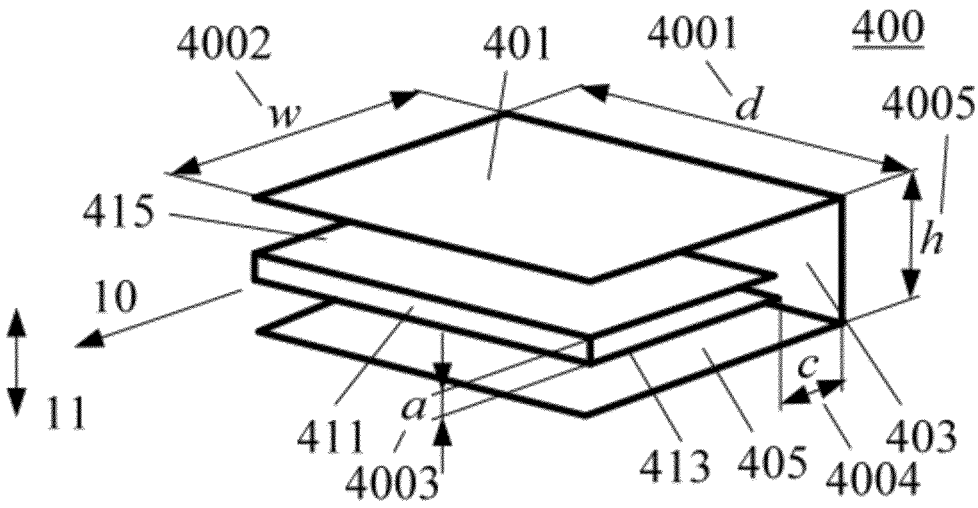
FIG. 4A illustrates a perspective view of an antenna according to embodiments of the present technology.
Figure 4B:
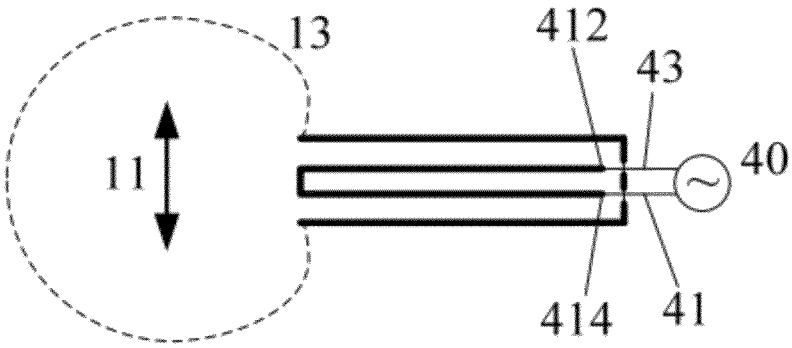
FIG. 4B illustrates a side view of the antenna of FIG. 4A including example feed points.

FIG. 4A and FIG. 4B illustrate an example antenna 400 according to an embodiment of the present technology. The example antenna 400 is a combination of the external antenna structure illustrated in FIG. 3A and the internal antenna structure illustrated in FIG. 3C. FIG. 4A illustrates a perspective view of the antenna 400, and FIG. 4B illustrates a side view of the antenna 400. FIG. 4B further illustrates an example connection to a signal drive source 40 for providing a signal to the antenna 400 for signal transmission purposes and a schematic illustration of a portion of a radiation pattern 13 of the antenna 400. It is noted that the antenna 400 can also be used for receiving signals. The antenna 400 can be configured to provide a bandwidth of up to or more than about 17% of its resonant frequency.

The antenna 400 comprises a conductive first plate 405, a conductive second plate 401, a back plate 403, a front plate 411, a conductive third plate 413, and a conductive fourth plate 415, which are electrically interconnected and configured as solid, substantially flat, rectangular, conductive plates having substantially equal depth d (4001). The antenna 400 may be integrally formed from two elongate substantially rectangular pieces of electrically conductive material such as copper, by folding or other method, for example. The internal antenna structure formed by the front plate 411, the conductive third plate 413, and the conductive fourth plate 415 may be durably disposed within the external antenna structure by a suitable dielectric that at least partially fills the space in between the conductive first plate 405 and the conductive second plate 401, for example. Depending on the embodiment, the inside of the internal antenna structure may be filled with a low loss dielectric material. A dielectric material with adequate dielectric properties can improve the bandwidth and provide the flatter antenna characteristics across the bandwidth. The back plate 403 provides the electrical connection between the conductive first plate 405 and the conductive second plate 401. The conductive third plate 413 and the conductive fourth plate 415 are of substantially equal size but can have different sizes in other embodiments.

The antenna 400, including the conductive first plate 405 and the conductive second plate 401, have an electrical length w (4002) with respect to the electrical connection provided by back plate 403 corresponding with about a quarter of the guide wavelength, $\lambda_0/4$, of the antenna 400. Depending on the embodiment, the height h (4005) of the antenna, the height a (4003) of the front plate 411 and the distance c (4004) between the proximate edge of the conductive third plate 413 and the back plate 403, can be different. The heights and distance c, h and a can be configured to provide a predetermined bandwidth of the antenna 400 and to affect the radiation pattern in planes perpendicular to the conductive first plate 405. For example, the internal antenna structure may be centered within the external antenna structure, h may be about $\lambda_0/10$, a may be about h/5 and c may be about h/5.

FIGS. 4A and 4B also schematically illustrate a forward direction 10 in which the antenna 400 emits substantial amounts of electromagnetic radiation, the axis of polarization 11 of the emitted electromagnetic radiation in the forward direction 10 and a portion of the radiation pattern 13 of the antenna 400. The radiation pattern 13 will be substantially symmetrical if the antenna 400 is substantially symmetrical. In a far-field approximation, the electromagnetic radiation emitted by the antenna 400 appears to originate from about the center of the front plate 411 and is consequently offset from the back plate 403 by about w.

The antenna 400 may be partially or completely filled and/or coated (not illustrated) with one or more dielectric materials that are characterized by predetermined dielectric properties. For example, the space between the conductive first plate 405 and the conductive second plate 401 may be partially or fully filled with one or more dielectric materials or predetermined dielectric properties, for example certain resins, mastics, plastics, paints, oils, paraffin, wax, or other dielectric materials. Remaining interfaces, if any, between dielectric materials and/or dielectric material and air may be curved, planar parallel, normal or oblique with respect to the conductive first plate 405. Dielectric material may also be applied by coating, painting or spraying one or more components of the antenna 400.

Example 2

Figure 5A:
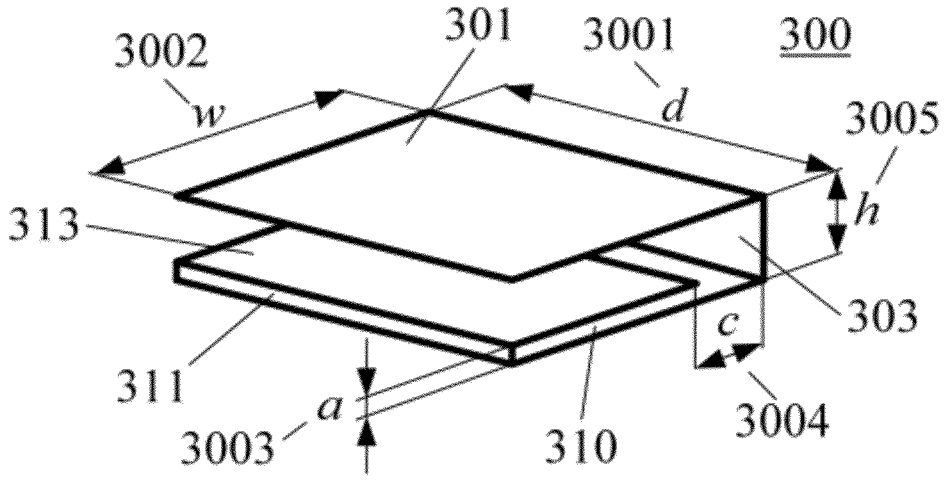
FIG. 5A illustrates a side view of an antenna according to embodiments of the present technology.
Figure 5B:
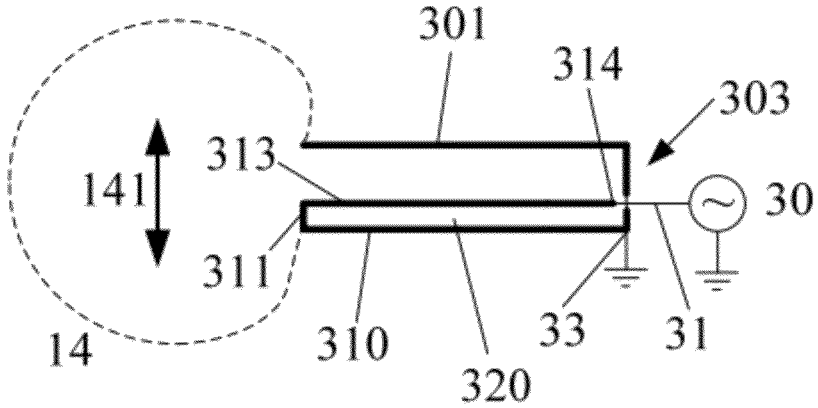
FIG. 5B illustrates a side view of the antenna of FIG. 5A including example feed points.

FIG. 5A and FIG. 5B illustrate an example antenna 300 according to an embodiment of the present technology. The example antenna 300 is a combination of the external antenna structure illustrated in FIG. 3A and the internal antenna structure illustrated in FIG. 3B. FIG. 5A illustrates a perspective view of the antenna 300, and FIG. 5B illustrates a side view of the antenna 300. FIG. 5B further illustrates an example connection to a signal drive source 30 for providing a signal to the antenna 300 for signal transmission purposes, a schematic illustration of a portion of a radiation pattern 14 and the axis of polarization 141 of the antenna 300. The antenna 300 can be configured to provide a bandwidth of up to or more than about 17% of its resonant frequency.

The antenna 300 comprises a conductive first plate 310, a conductive second plate 301, a back plate 303, a front plate 311 and a conductive third plate 313, which are electrically interconnected and configured as solid, substantially flat, rectangular, conductive plates having substantially equal depth d (3001). The antenna 300 may be integrally formed from a single elongate substantially rectangular piece of material such as copper, by folding, for example. The back plate 303 provides the electrical connection between the conductive first plate 310 and the conductive second plate 301.

The antenna 300, including the conductive first plate 310 and the conductive second plate 301, have an electrical length w (3002) with respect to the electrical connection corresponding with a quarter of the guide wavelength, $\lambda_0/4$, of the antenna 300. Depending on the embodiment, the height h (3005) of the antenna, the height a (3003) of the front plate 311 and the distance c (3004) between the proximate edge of the conductive third plate 311 and the back plate 303, can vary within predetermined ranges. The heights and distance c, h and a can be configured to provide a predetermined bandwidth of the antenna 300 and to affect the radiation pattern in planes perpendicular to the conductive first plate 310. In a far-field approximation, the electromagnetic radiation emitted by the antenna 300 appears to originate from about the center of the opening proximate the front plate 311 and is consequently offset from the back plate 303 by about w.

The antenna 300 may be partially or completely filled and/or coated (not illustrated) with one or more dielectric materials that are characterized by predetermined dielectric properties. For example, the space 320 between the conductive first plate 310 and the conductive third plate 313 may be partially or fully filled with one or more dielectric materials. Interfaces between dielectric materials and/or dielectric material and air remaining in the space 320 may be parallel, normal or oblique with respect to the conductive first plate 310. Dielectric material may also be applied by coating, painting or spraying one or more components of the antenna 300.

The depth d of the antenna can be configured to substantially affect the radiation pattern of the antenna 300 within planes parallel to the conductive first plate 310. An example geometry of the antenna 300 may be characterized by $w=\lambda_0/4$, $d=\lambda_0/4$, $h=\lambda_0/10$, $c=\lambda_0/40$, and $a=\lambda_0/40$, wherein "=" corresponds to nominal values that are equal or about the specified value as defined herein. Other example antennas can be characterized by other widths, depths, heights and/or lengths d, h, c and/or a. It is noted that antennas in which d, h, c and/or a are different can have different guide wavelength $\lambda_0$ even if the antennas are characterized by substantially equal w.

As illustrated in FIG. 5B, the antenna 300 is grounded. The grounding may occur at a predetermined point along edge 33, along the whole edge 33, the whole conductive first plate 310 may be used as a ground plate, or other grounding may be provided. The signal drive source is operatively connected to the antenna at feed point 314 through an opening in the back wall 303. It is noted that other antennas may be grounded in other locations, the feed point may be provided in other locations, and/or more than one feed point may be provided. It is further noted that the specific location(s) of the one or more feed points and/or of the grounding of the antenna can affect the guide wavelength, bandwidth and/or other characteristics of an antenna.

An example configuration of the antenna 300 can be dimensioned and formed from a piece of copper about 0.01 mm to about 0.5 mm thick, for example, about 0.2 mm thick, and 28 mm wide as described below. Depending on the embodiment, the antenna can be mechanically self supporting. For example, parts of or the entire antenna can be made from material thick enough to control bending or warping thereof even if, from an electrical perspective, the antenna may work with thinner or narrower components. For example, when a copper antenna is configured for operation at frequencies, such as above 400 MHz, substantial electrical currents within the antenna occur only within thin surface layers of certain conductive components of the antenna due to the skin effect. Depending on the embodiment, antennas configured for low frequencies which are large may comprise electrically conductive material with apertures therein to reduce weight and/or cost. For this purpose, such antenna may be made from perforated or meshed material, for example. Depending on the embodiment, such apertures may need to be small in comparison to the guide wavelength.

The conductive first plate 310 and the conductive second plate 301 are about 28 mm by about 28 mm in size. The back plate 303 is about 10 mm high by about 28 mm wide. The first plate 310 and the third plate 311 are separated by a dielectric body characterized by a relative dielectric constant of about 3.6 and a thickness of about 0.5 mm. The dielectric body is about 28 mm wide and about 21 mm deep. The piece of copper is folded around the dielectric body providing an integrally formed conductive first plate, conductive second plate, conductive third plate, conductive back plate and conductive front plate. The conductive third plate is dimensioned to provide c of about 5 mm. A return loss of about 10 dB can be accomplished using, for example, a predetermined printed inductor disposed in combination with a predetermined printed shunt capacitor between the feed point 314 and the signal drive source 30. The resulting antenna when disposed on a ground plane about 50 mm by about 50 mm can be characterized by a bandwidth of about 310 MHz and a center frequency of about 1860 MHz, corresponding to a free space wavelength of about 161 mm, a bandwidth of about 16.6%, a predetermined flat return loss within the bandwidth, a substantially perpendicular polarization, about omnidirectional within 2 dB (+/−1 dB) radiation pattern in a plane perpendicular to the polarization, and an efficiency about 70% or better within the bandwidth.

Figure 6:
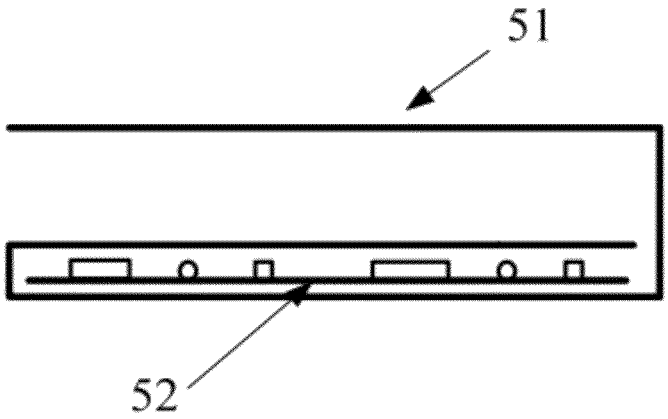
FIG. 6 illustrates a side view of an antenna and electronic circuitry according to embodiments of the present technology.

As illustrated in FIG. 6, a printed circuit board 52 including electronics or other components, may be disposed within the internal antenna structure of an antenna 51 or other antenna according to embodiments of the present technology. A printed circuit board, electronics and/or other components may also be disposed within other areas (not illustrated) of the antenna 51 or in addition to the printed circuit board 52. It is noted that disposition of a printed circuit board, electronics or other components within or proximate an antenna according to embodiments of the present technology may affect one or more properties of the antenna, for example, the bandwidth and/or the guide wavelength. Disposition of a printed circuit board, electronics and/or other components proximate or within an antenna may enable making the antenna smaller or bigger than a corresponding antenna without such elements. Furthermore, the antenna may protect and/or shield nearby or inserted elements from various influences including electromagnetic fields, or may, with or without combination with additional conductive elements (not illustrated) provide a partial or full Faraday shield, for example.

Figure 9:
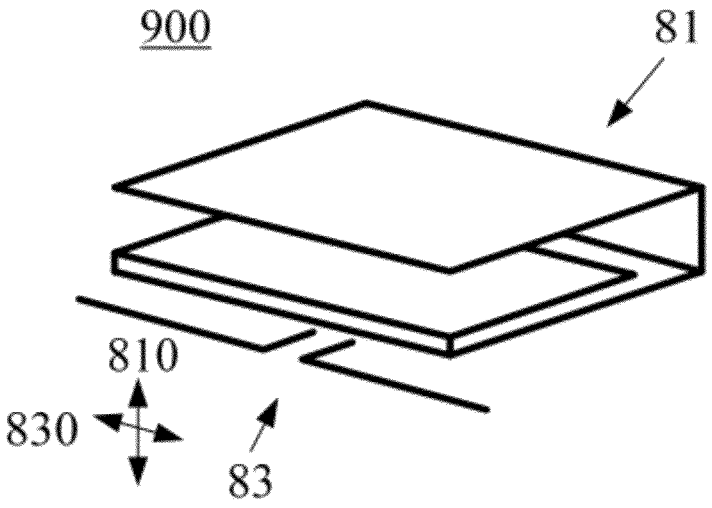
FIG. 9 illustrates a perspective view of a disposition of antennas according to embodiments of the present technology.
Figure 10:
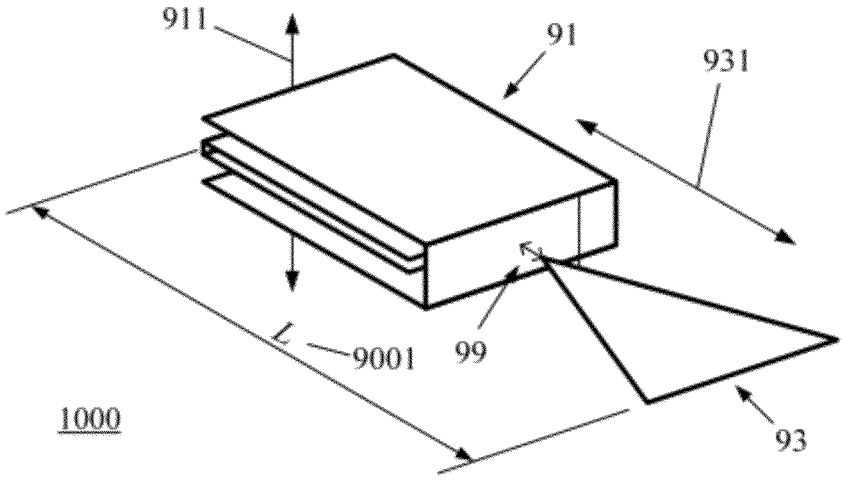
FIG. 10 illustrates a perspective view of a disposition of antennas according to embodiments of the present technology.

As schematically illustrated in FIGS. 7A, 7B, 8A and 8B two or more antennas according to embodiments of the present technology may be stacked, nested or otherwise combined into corresponding antenna systems. FIGS. 9 and 10 illustrate combinations of example antennas according to embodiments of the present technology with other types of antennas. It is noted that more than one antenna according to embodiments of the present technology may be combined with other antennas. Combinations of antennas may comprise galvanic/resistive, capacitive and/or conductive couplings for connecting the combined antennas. Depending on the embodiment, galvanic/resistive couplings may provide for simple antenna feed(s).

It is noted that antennas of antenna systems according to embodiments of the present technology may be oriented in different directions. Antenna systems with differently oriented but otherwise equal antennas may have similar or substantially different properties. Corresponding antenna systems may be characterized by substantially equal, similar or different radiation patterns, for example. For example, two or more antennas may be disposed with different forward directions yet substantially parallel polarization, or with orthogonal polarization but same or different forward directions. Corresponding antenna systems may be operated to achieve predetermined antenna diversity or beam forming, for example, which may be used in communication systems which can selectively communicate depending on direction. Antenna systems with antennas according to embodiments of the present technology can be employed in a Butler matrix and/or operated using hybrid signal drive sources or the like.

Antenna systems as per FIGS. 7A, 7B, 8A, 8B, 9, 10 or other antenna systems including one or more antennas according to embodiments of the present technology, may be employed to cover multiple communication bands, increase bandwidth, provide additional polarization and/or forward direction or provide an antenna system with other properties in comparison to the properties provided by each of the antennas of the antenna system when viewed by itself.

Figure 7A:
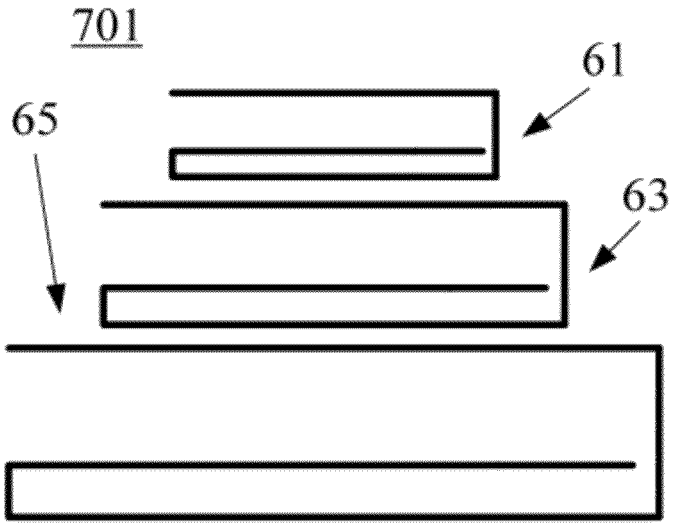
FIG. 7A illustrates a side view of a disposition of antennas according to embodiments of the present technology.

FIG. 7A illustrates an example antenna system 701 comprising three antennas 61, 63 and 65 of generally similar design but different guide wavelengths that are disposed in a stack-like fashion. The antenna system 701 may be configured to cover combinations of communication bands for WiMAX™, WiFi, personal communication service (PCS), and cellular communication, or other combination of communication bands, for example. The antenna system 701 can be configured so that each of the antennas provides about 30% bandwidth with respect to each of the center frequencies thereof. It is noted that due to mutual interaction within the antenna system 701 each of the antennas 61, 63 and 65 may substantially differ in dimensions from a corresponding antenna configured for the same center frequency. Depending on the embodiment, the antenna system 701 may comprise galvanic/resistive, capacitive and/or inductive coupling elements (not illustrated) to electrically and/or mechanically couple the antennas 61, 63 and 65. For example, the antennas 61, 63 and 65 may touch each other (not illustrated) or be disposed apart from each other by one or more suitable support elements or cast in adequate dielectric material (not illustrated), be integrally formed (not illustrated), soldered, welded, glued or otherwise coupled to one another. Depending on the embodiment, for example galvanic/resistive couplings, may provide for simple antenna feed(s).

Figure 7B:
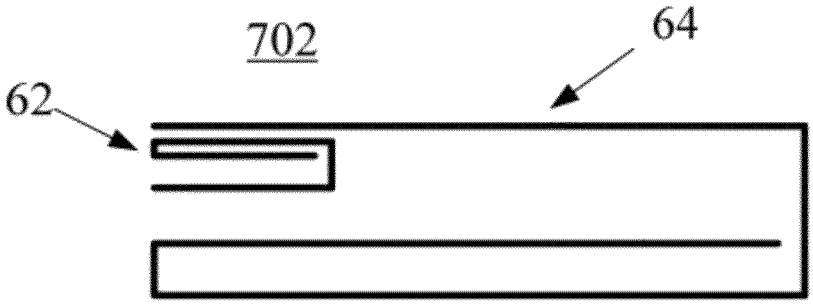
FIG. 7B illustrates a side view of a disposition of antennas according to embodiments of the present technology.

FIG. 7B illustrates an example antenna system 702 comprising two nested antennas 62 and 64 that are disposed in the specific relative orientation as illustrated. It is noted that the antennas 61, 63 and 65, or 62 and 64 may be disposed and/or aligned with respect to one another in a manner other than that illustrated. Optional dielectric and/or insulating elements for disposing and separating the antennas 61, 63 and 65, or 62 and 64 are not illustrated. Depending on the embodiment, the antenna system 702 may comprise galvanic/resistive, capacitive and/or inductive coupling elements (not illustrated) to electrically and/or mechanically couple the antennas 62 and 64. For example, the antennas 62 and 64 may touch each other (not illustrated) or be disposed apart from each other by one or more suitable support elements or cast in adequate dielectric material (not illustrated), be integrally formed (not illustrated), soldered, welded, glued or otherwise coupled to one another. Depending on the embodiment, for example galvanic/resistive couplings, may provide for simple antenna feed(s).

Figure 8A:
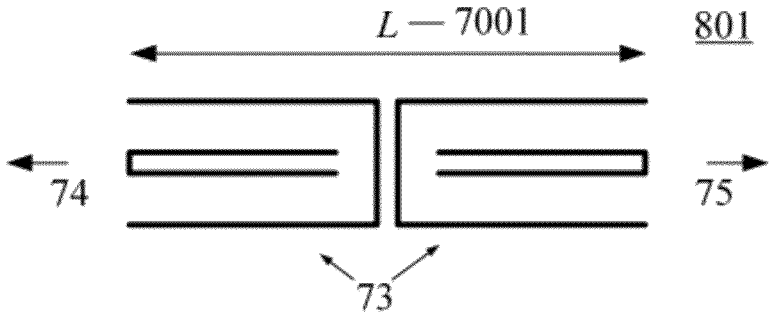
FIG. 8A illustrates a side view of a disposition of antennas according to embodiments of the present technology.
Figure 8B:
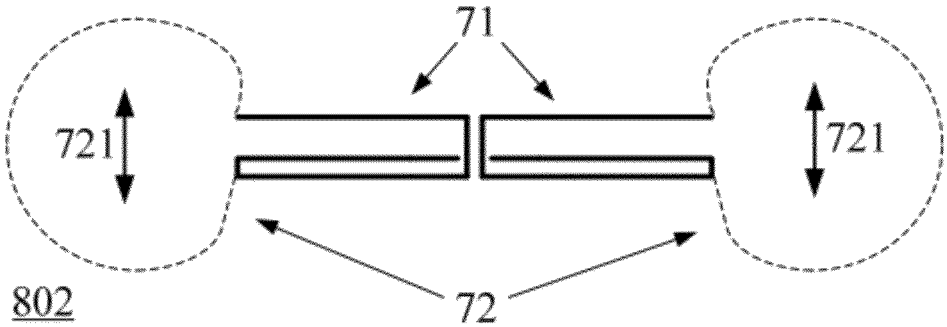
FIG. 8B illustrates a side view of a disposition of antennas according to embodiments of the present technology.

FIG. 8A illustrates an example antenna system 801 comprising two substantially geometrically equal antennas 73 according to an embodiment of the present technology disposed with opposing forward directions 74 and 75. FIG. 8B illustrates another example antenna system 802 comprising two antennas 71 with substantially equal geometry according to an embodiment of the present technology disposed with opposing forward directions. FIG. 8B further illustrates portions of radiation patterns 72 and axes of polarization 721 of each of the antennas 71. The example antenna systems 801 and 802 can have an overall electrical length L (7001) of about $\lambda_0/2$.

Without considering effects due to mutual influences between proximate antennas in antenna systems 701, 702, 801 and 802 during operation, which may substantially affect the performance of the antenna system, each antenna in the antenna system can be considered separately. Consequently, the operating characteristics of each of the antenna systems 701, 702, 801 and 802, for example, can be considered as a superposition of the operating characteristics of each of its antennas. Accordingly, a superposition of the operating characteristics of each of the antennas 61, 63 and 65 will approximate the operating characteristics of the antenna system 701, for example. Deviations of so estimated operating characteristics of an antenna system from its actual operating characteristics may occur and affect guide wavelength(s), bandwidths and/or other properties.

Deviations in antenna systems which include substantially decoupled antennas may be small. For example, in an antenna system including antennas with perpendicular polarization, mutual influences between the antennas may be substantially limited. FIGS. 9 and 10 illustrate examples of antenna systems with two perpendicular polarized antennas. Antenna systems with three perpendicular polarized antennas are also possible.

FIG. 9 illustrates an example antenna system 900 comprising an example antenna 81 according to an embodiment of the present technology and a linearly polarizing antenna 83, generally indicated as a dipole antenna. The antenna 81 has a polarization axis 810 and the antenna 83 has a polarization axis 830. The polarization axes 810 and 830 are substantially perpendicular.

FIG. 10 illustrates another example antenna system 1000 comprising an example antenna 91 according to an embodiment of the present technology and a linearly polarizing antenna 93, generally indicated as a triangular patch, which may be referred to as a monopole. The antenna 91 has a polarization axis 911 and the antenna 93 has a polarization axis 931. The polarization axes 911 and 931 are substantially perpendicular. FIG. 10 also illustrates example feed points 99 for providing a drive signal for driving the antenna 93 relative to the antenna 91. Feed points for driving the antenna 91 are not illustrated. The antenna system 1000 has an electrical length L (9001) of about $\lambda_0/2$.

It is obvious that the foregoing embodiments of the technology are examples and can be varied in many ways. Such present or future variations are not to be regarded as a departure from the spirit and scope of the technology, and all such modifications as would be obvious to one skilled in the art are intended to be included within the scope of the following claims.

I claim:

1. An antenna comprising:

a. a conductive first plate and a conductive second plate, the conductive first plate and the conductive second plate disposed and having a first galvanic connection between an edge of the conductive first plate and an edge of the conductive second plate to form an external antenna structure, the conductive first plate and the conductive second plate having electrical lengths in the same direction with respect to the first connection corresponding to an odd integer multiple of a quarter of a guide wavelength or less associated with a resonant frequency of the antenna; and b. a conductive third plate disposed parallel to the conductive first plate between the conductive first plate and the conductive second plate, the conductive third plate having a proximate edge positioned proximal to the first connection and a distant edge positioned distal to the first connection, wherein the conductive third plate forms part of an internal antenna structure provided with a feed point configured for transmission or reception of antenna signals, wherein the internal antenna structure is free from contact with the external antenna structure, wherein the internal antenna structure further comprises a conductive fourth plate having a second galvanic connection to the conductive third plate and disposed parallel to the conductive second plate between the conductive second plate and the conductive third plate, wherein the conductive fourth plate has a proximate edge positioned proximal to the first connection and a distant edge positioned distal to the first connection, and wherein dielectric structure surrounds the internal antenna structure and keeps the internal antenna structure within the external antenna structure.

2. The antenna according to claim 1, wherein the conductive third plate and the conductive fourth plate have said second galvanic connection at the respective distant edge of each.

3. The antenna according to claim 1, wherein the conductive third plate and the conductive fourth plate have equal electrical lengths with respect to the respective proximate edge of each.

4. The antenna according to claim 3, wherein the conductive third plate and the conductive fourth plate have electrical lengths with respect to the first connection corresponding to an odd integer multiple of a quarter of a guide wavelength or less associated with the resonant frequency.

5. The antenna according to claim 4, wherein the conductive first plate, the conductive second plate, the conductive third plate and the conductive fourth plate have equal electrical lengths with respect to the first connection.

6. The antenna according to claim 1, wherein the conductive fourth plate provides the feed point.

7. The antenna according to claim 6, wherein the feed point is disposed near the proximate edge of the conductive fourth plate.

8. The antenna according to claim 6, wherein the feed point is operatively connected to a drive system via a through hole in the external antenna structure.

9. The antenna according to claim 1, wherein the external antenna structure is grounded and the conductive third plate provides the feed point for driving the antenna.

10. The antenna according to claim 8, wherein the external antenna structure is grounded near the first connection and the feed point is disposed near the proximate edge of the conductive third plate.

11. The antenna according to claim 9, wherein the feed point is operatively connected to a drive system via a through hole in the external antenna structure.

12. The antenna according to claim 1, wherein the first connection comprises a back plate.

13. The antenna according to claim 1, wherein the conductive first plate is planar.

14. The antenna according to claim 1, wherein the conductive second plate is planar.

15. The antenna according to claim 1, wherein the conductive third plate is planar.

16. The antenna according to claim 1, wherein the conductive fourth plate is planar.

17. The antenna according to claim 1, wherein the conductive third plate has an electrical length with respect to the proximate edge corresponding to a second odd integer multiple of a quarter of the guide wavelength or less.

18. The antenna according to claim 1, wherein a distance between the conductive third plate and the conductive first plate is equal or smaller than a distance between the proximate edge of the conductive third plate and the first connection.

* * * * *